US010566128B2

(12) United States Patent
Jang et al.

(10) Patent No.: US 10,566,128 B2
(45) Date of Patent: Feb. 18, 2020

(54) POWER INDUCTOR WITH A CHIP STRUCTURE

(71) Applicant: SAMSUNG ELECTRO-MECHANICS CO., LTD., Suwon-si, Gyeonggi-do (KR)

(72) Inventors: Young Su Jang, Suwon-si (KR); Bum Sik Wang, Suwon-si (KR); Jin Hwan Kim, Suwon-si (KR); Hwi Dae Kim, Suwon-si (KR); Min Ha Hwang, Suwon-si (KR)

(73) Assignee: SAMSUNG ELECTRO-MECHANICS CO., LTD., Suwon-si, Gyeonggi-do (KR)

( * ) Notice: Subject to any disclaimer, the term of this patent is extended or adjusted under 35 U.S.C. 154(b) by 45 days.

(21) Appl. No.: 15/457,235

(22) Filed: Mar. 13, 2017

(65) Prior Publication Data

US 2017/0372833 A1 Dec. 28, 2017

(30) Foreign Application Priority Data

Jun. 24, 2016 (KR) ..... 10-2016-0079247

(51) Int. Cl.
*H01F 27/29* (2006.01)
*H01F 27/28* (2006.01)

(52) U.S. Cl.
CPC ..... *H01F 27/2804* (2013.01); *H01F 27/29* (2013.01); *H01F 2027/2809* (2013.01)

(58) Field of Classification Search
CPC ..... H01F 27/2804; H01F 27/29; H01F 2027/2809
USPC ..... 336/200, 232
See application file for complete search history.

(56) References Cited

U.S. PATENT DOCUMENTS 6,489,875 B1 12/2002 Uchikoba et al.
8,686,823 B2 * 4/2014 Asano ..... H01F 27/22 165/185
2002/0044379 A1 * 4/2002 Kobayashi ..... G11B 5/3116 360/123.41
2004/0140528 A1 * 7/2004 Kim ..... H01F 21/12 257/537
2004/0145442 A1 * 7/2004 Matsutani ..... H01F 21/12 336/200
2004/0246084 A1 * 12/2004 Matsutani ..... H01F 17/04 336/5

(Continued)

FOREIGN PATENT DOCUMENTS

CN 103872008 A * 6/2014
JP 2001-023822 A 1/2001

(Continued)

*Primary Examiner* — Tszfung J Chan
(74) *Attorney, Agent, or Firm* — Morgan, Lewis & Bockius LLP

(57) ABSTRACT

An inductor includes first and second coil patterns disposed in a single chip, and at least one common lead terminal electrically connected to respective end portions of the first and second coil patterns. The first and second coil patterns operate independently of each other, such that a range of a current passing through the first coil pattern and a range of a current passing through the second coil pattern are different from each other. The first and second coil patterns are coil patterns having different electrical characteristics.

24 Claims, 9 Drawing Sheets

(56) References Cited

U.S. PATENT DOCUMENTS

| | | | | |
|---|---|---|---|---|
| 2010/0026368 | A1* | 2/2010 | Tang | H01L 23/48 336/200 |
| 2010/0148905 | A1 | 6/2010 | Matsumoto | |
| 2014/0167896 | A1* | 6/2014 | Tung | H01F 17/0013 336/5 |
| 2014/0175899 | A1* | 6/2014 | Miyashita | H01F 38/14 307/104 |
| 2015/0028988 | A1* | 1/2015 | Yamauchi | H01F 27/2804 336/200 |
| 2015/0340141 | A1* | 11/2015 | Yoshida | H01F 6/06 505/211 |

FOREIGN PATENT DOCUMENTS

| | | | | | |
|---|---|---|---|---|---|
| JP | 2001085230 | A | * | 3/2001 | H01F 27/2804 |
| JP | 2013-183031 | A | | 9/2013 | |
| KR | 10-2010-0069604 | A | | 6/2010 | |

* cited by examiner

I - I'

II - II'

Ⅲ-Ⅲ'

IV-IV'

V-V'

VI-VI'

POWER INDUCTOR WITH A CHIP STRUCTURE

CROSS-REFERENCE TO RELATED APPLICATION

This application claims benefit of priority to Korean Patent Application No. 10-2016-0079247 filed on Jun. 24, 2016 in the Korean Intellectual Property Office, the disclosure of which is incorporated herein by reference in its entirety.

BACKGROUND

1. Field

The present disclosure relates to an inductor, and more particularly, to a power inductor having a chip structure.

2. Description of Related Art

Recent increases in current consumption have arisen from improvements in the performance of semiconductors (an application processor (AP), a memory, or the like) used in portable apparatuses (a smartphone, an Internet of Things (IoT) apparatus, and the like). As a result, various types of technology have been applied in order to improve efficiency, including multiphase converter technology. In this technology, power inductors used in an output of a converter are connected to each other in parallel, which decreases power inductor losses at a high current and enables miniaturization of the power inductors.

Power inductor losses vary depending on the current. Generally, alternating current (AC) loss dominates in a low current section, while direct current (DC) loss dominates in a high current section. Therefore, in order to decrease power inductor losses throughout an entire range of currents, it is important to increase an inductance value in the low current section and to decrease a DC resistance value in the high current section.

Japanese Patent Laid-Open Publication No. 2001-023822 discloses a chip inductor array in which a plurality of coils are included in a single chip inductor. However, in this chip inductor array, the plurality of coils in the single chip inductor are designed to have substantially the same characteristics, and thus, loss throughout the entire current section is not effectively controlled.

SUMMARY

An aspect of the present disclosure may provide an inductor in which efficiency throughout an entire current band from a low current region to a high current region may be significantly increased.

According to an aspect of the present disclosure, an inductor may be provided in which a plurality of coils having different electrical characteristics are disposed in a single chip and may implement different current paths in a high current section and a low current section.

BRIEF DESCRIPTION OF DRAWINGS

The above and other aspects, features, and advantages of the present disclosure will be more clearly understood from the following detailed description taken in conjunction with the accompanying drawings, in which.

DETAILED DESCRIPTION

Hereinafter, exemplary embodiments of the present disclosure will now be described in detail with reference to the accompanying drawings.

Figure 1:
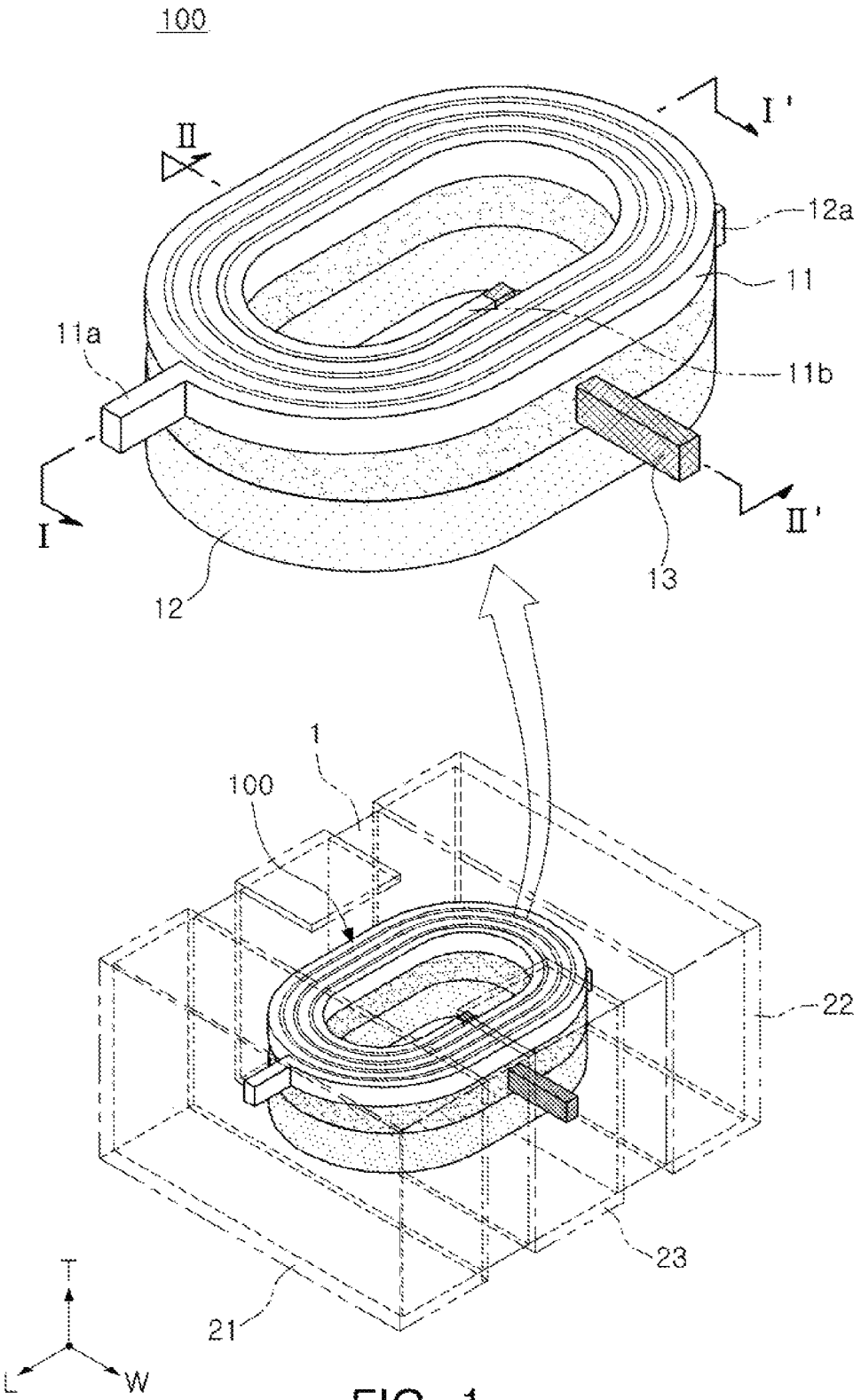
FIG. 1 is a schematic perspective view illustrating an inductor according to an exemplary embodiment in the present disclosure.

FIG. 1 is a schematic view illustrating an inductor according to an exemplary embodiment in the present disclosure used in an electronic apparatus.

Figure 2:
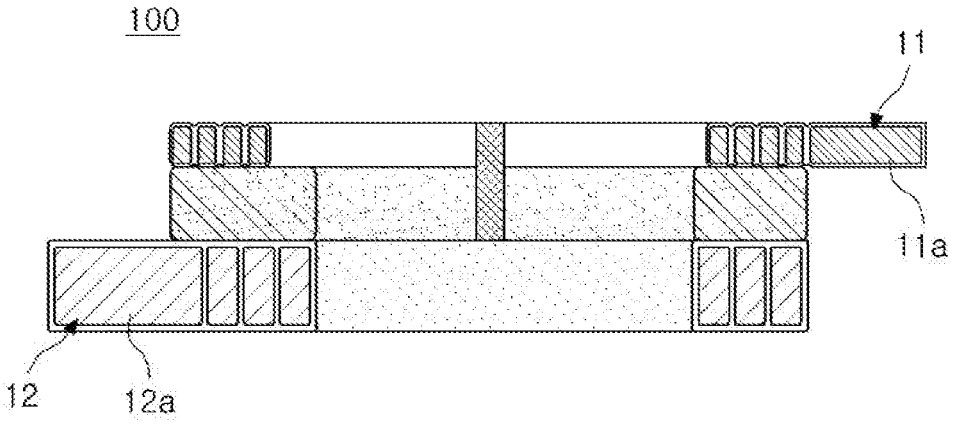
FIG. 2 is a cross-sectional view of the inductor taken along line I-I' of FIG. 1.
Figure 3:
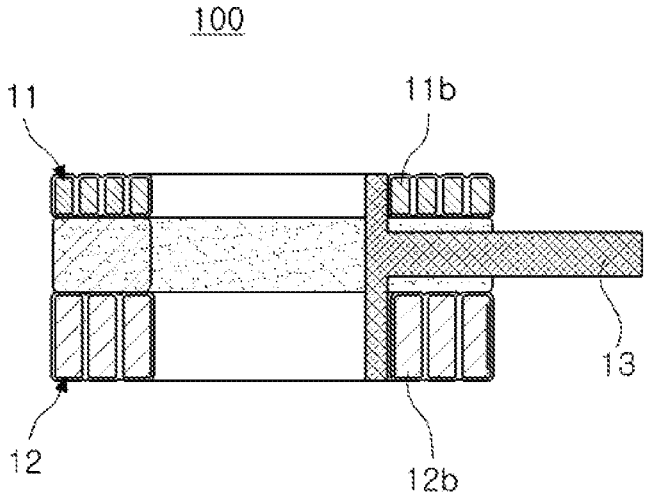
FIG. 3 is a cross-sectional view of the inductor taken along line II-II' of FIG. 1.

FIG. 2 is a cross-sectional view of the inductor taken along line I-I' of FIG. 1. FIG. 3 is a cross-sectional view of the inductor taken along line II-II' of FIG. 1.

Figure 4:
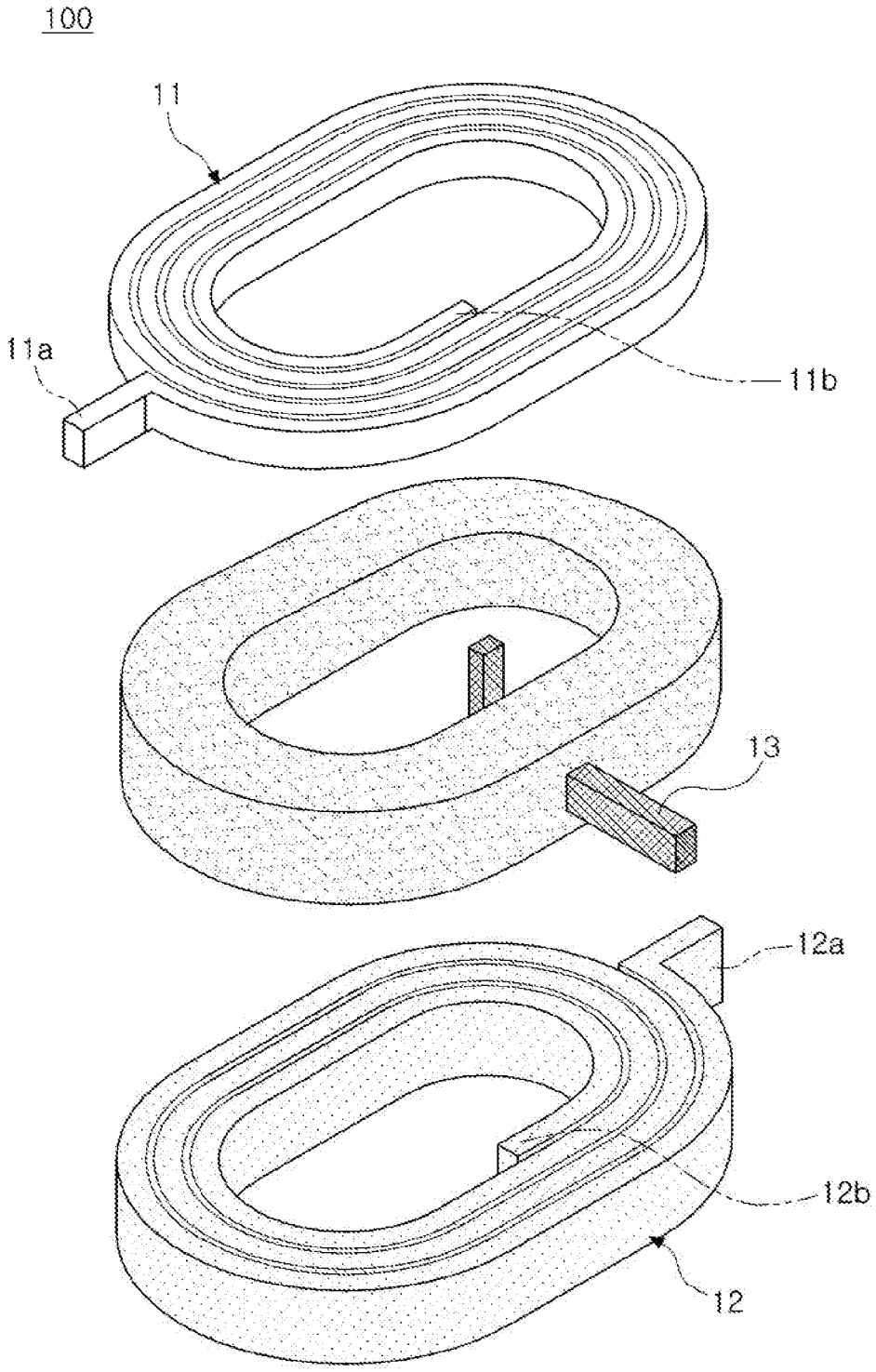
FIG. 4 is a schematic exploded perspective view of the inductor of FIG. 1.

FIG. 4 is a schematic exploded perspective view of the inductor of FIG. 1.

Referring to FIG. 1, an inductor 100 according to an exemplary embodiment in the present disclosure may include a body 1 and a plurality of lead terminals 21, 22, and 23 disposed on outer surfaces of the body 1.

Where the inductor has a body 1 of the form illustrated in FIG. 1, an upper surface and a lower surface are surfaces opposing each other in a thickness direction "T," a first surface and a second surface are the surfaces opposing each other in a length direction "L," and a third surface and a fourth surface are the surfaces opposing each other in a width direction "W." The body 1 illustrated in FIG. 1 has a substantially hexahedral shape, but the present disclosure is not limited thereto.

The body 1 may include a magnetic material having magnetic properties, such as Mn—Zn-based ferrite, Ni—Zn-based ferrite, Ni—Zn—Cu-based ferrite, Mn—Mg-based ferrite, Ba-based ferrite, Li-based ferrite, or the like. The body 1 may include a metal magnetic particle. The metal magnetic particle may include one or more selected from the group consisting of iron (Fe), silicon (Si), chromium (Cr), aluminum (Al), and nickel (Ni). For example, the metal magnetic particle may be formed of a Fe—Si—B—Cr based amorphous metal, but is not necessarily limited thereto. The metal magnetic particle may have a diameter of about 0.1 μm to 30 μm. The body 1 may have a form in which the ferrites or the metal magnetic particles are dispersed in a thermosetting resin such as an epoxy resin, a polyimide resin, or the like.

The metal magnetic particles may be metal magnetic powders having at least two average particle sizes. In this case, bimodal metal magnetic powders having different sizes may be compressed and fully filled in a magnetic material-resin composite, such that a packing factor of the magnetic material-resin composite may be increased.

The body 1 may include a first coil pattern 11 and a second coil pattern 12.

The first coil pattern 11 and the second coil pattern 12 will be described in detail with reference to FIGS. 1 through 4.

The first coil pattern 11 may include a first end portion 11*a* and a second end portion 11*b* connected to the first end portion 11*a*. The first coil pattern 11 includes a plurality of conductor patterns (i.e., coils), which may be continuously formed to thereby be electrically connected to each other from the first end portion to the second end portion.

The second coil pattern 12 may include a third end portion 12*a* and a fourth end portion 12*b* connected to the third end portion 12*a*. The second coil pattern 12 includes a plurality of conductor patterns, which may be continuously formed to thereby be electrically connected to each other from the third end portion to the fourth end portion.

The first coil pattern 11 and the second coil pattern 12 may have different inductance values and different direct current (DC) resistance values per unit length.

An inductance value of the first coil pattern 11 may be greater than that of the second coil pattern 12, and a DC resistance value per unit length of the first coil pattern 11 may be greater than that of the second coil pattern 12. On the other hand, an inductance value of the second coil pattern 12 may be lower than that of the first coil pattern 11, and a DC resistance value per unit length of the second coil pattern 12 may be lower than that of the first coil pattern 11.

The method of making the inductance values and the DC resistance values per unit length of the first coil pattern 11 and the second coil pattern 12 different from each other is not particularly limited. For example, the widths of individual conductor patterns in the first coil pattern may be decreased to increase the turns number of the conductor patterns and thus increase the inductance value. In addition, the thickness of the second coil pattern may be increased in order to decrease the DC resistance value per unit length.

The DC resistance value per unit length of the second coil pattern 12 may be smaller than that of the first coil pattern 11, and Irms of the second coil pattern 12 may be greater than that of the first coil pattern 11. This may be associated with a circuit configured so that a higher current flows to the second coil pattern than to the first coil pattern when the inductor 100, according to the exemplary embodiment, is configured in a chip shape. For example, in a standby mode where a relatively large current is not required, the circuit may be configured so that the current flows to the first coil pattern, whereas in an active mode where relatively large current is required, the circuit may be configured so that the current flows to the second coil pattern.

Generally, alternating current (AC) loss (hereinafter, referred to as $P_{ACR}$) dominates in a low current section, while direct current (DC) loss (hereinafter, referred to as $P_{DCR}$) dominates in a high current section. Therefore, in order to decrease loss of an inductor throughout an entire current section from the low current section to the high current section, it is effective to focus on a decrease of $P_{ACR}$ in the low current section and focus on a decrease of $P_{DCR}$ in the high current section. Meanwhile, it is important to increase an inductance value in order to decrease $P_{ACR}$, and it is important to reduce a DC resistance value in order to decrease $P_{DCR}$. The inductor 100 according to the exemplary embodiment includes the first coil pattern 11, with a relatively large inductance, and the second coil pattern 12, with a relatively small DC resistance, in a single chip. The first coil pattern 11 with a relatively large inductance is operated in the low current section and the second coil pattern 12 with a relatively small DC resistance is operated in the high current section. As such, losses of the inductor 100 may be decreased throughout the entire current section.

A low current and a high current may be defined relative to each other. The low current can refer to a current in a standby mode of an electronic component and the high current can refer to a current in an active mode of the electronic component. Alternatively, the low current can refer to a current lower than a specific current value (Ic) at which $P_{ACR}$ of the inductor and $P_{DCR}$ of the inductor become equal to each other, and the high current can refer to a current value equal to or higher than the specific current value (Ic).

The first end portion 11*a* of the first coil pattern 11 may lead out to the first surface of the body to connect to a first lead terminal disposed on the first surface of the body. The first lead terminal may cover the first surface of the body, and may extend to one or more of the upper surface, the lower surface, the third surface, and the fourth surface of the body adjacent to the first surface of the body.

The third end portion 12*a* of the second coil pattern 12 may lead out to the second surface of the body to connect to a second lead terminal disposed on the second surface of the body. The second lead terminal may cover the second surface of the body, and may extend to one or more of the upper surface, the lower surface, the third surface, and the fourth surface of the body adjacent to the second surface of the body.

A common lead terminal 23 may be disposed between the first lead terminal 21 and the second lead terminal 22. One portion of the common lead terminal 23 may be electrically connected to the second end portion 11*b* of the first coil pattern 11, and another end portion of the common lead terminal 23 may be electrically connected to the fourth end portion 12*b* of the second coil pattern 12. The common lead terminal may be disposed on the third surface and the fourth surface opposing each other in the width direction of the body, and may extend from the third surface, across the upper surface, and to the fourth surface of the body or extend from the third surface, across the lower surface, and to the fourth surface of the body. The common lead terminal may have, for example, an approximately "U" shape.

The first lead terminal, the second lead terminal, and the common lead terminal may include a material having excellent electrical conductivity, and may further include a conductive resin layer and a conductor layer formed on the conductive resin layer. The conductive resin layer may be formed by printing paste, and may include one or more conductive metals selected from the group consisting of copper (Cu), nickel (Ni), and silver (Ag), and a thermosetting resin. The conductor layer may include one or more selected from the group consisting of nickel (Ni), copper (Cu), and tin (Sn). For example, a nickel (Ni) layer and a tin (Sn) layer may be sequentially formed in the conductor layer by plating.

Figure 5:
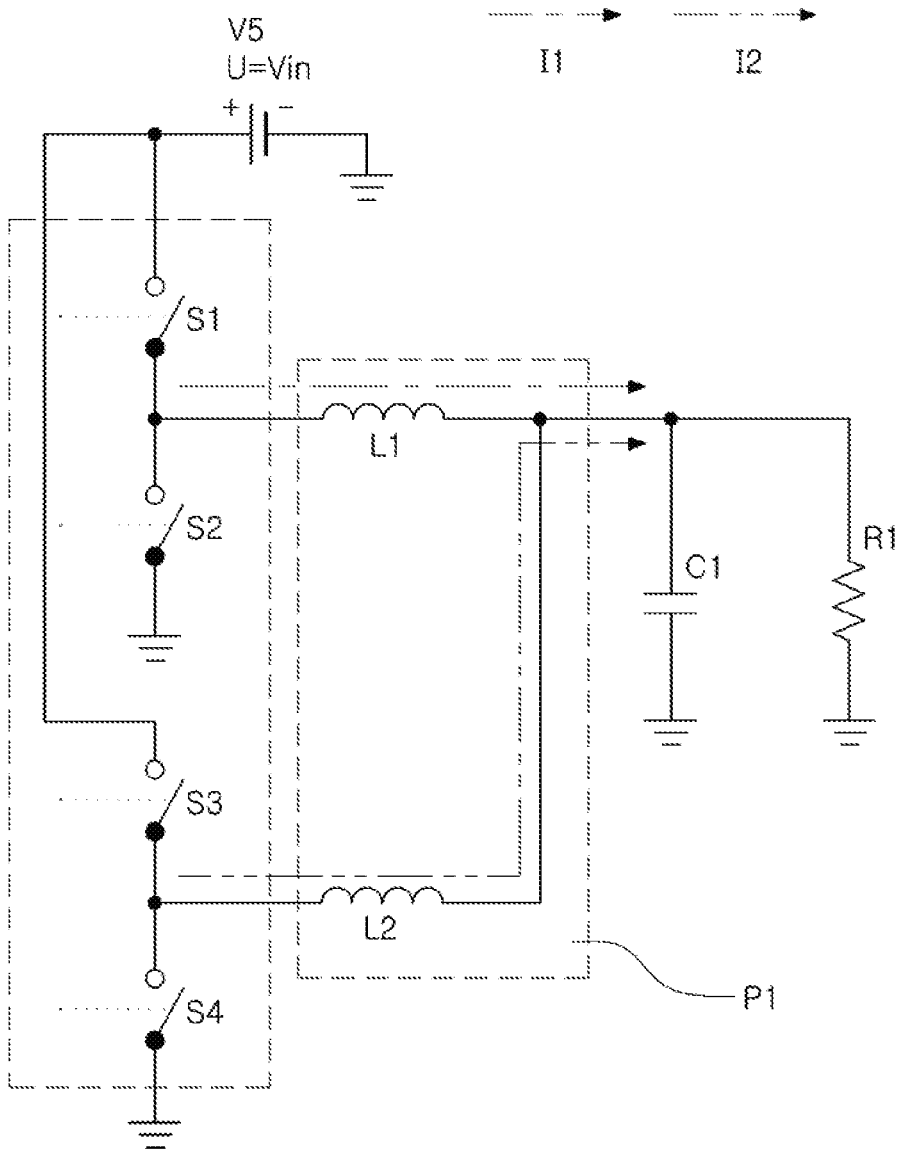
FIG. 5 is a schematic equivalent circuit diagram of a circuit including the inductor of FIG. 1.

FIG. 5 is a schematic equivalent circuit diagram of a circuit including the inductor of FIG. 1.

The section "P1" of FIG. 5 contains an equivalent circuit diagram of the inductor according to the exemplary embodiment.

Referring to the section P1 of FIG. 5, a current I1 input through the first lead terminal may be output through the common lead terminal, and a current I2 input through the second lead terminal may be output through the common lead terminal. The first lead terminal and the second lead terminal may each be lead terminals for an input, and the common lead terminal may be a lead terminal for an output. The common lead terminal may be a common output terminal selectively outputting the current I1 input through the first lead terminal or the current I2 input through the second lead terminal. The current I1 input through the first lead terminal or the current I2 input through the second lead terminal may be selectively input. Resultantly, a current output through the common lead terminal may be the current I1 or the current I2, and two currents I1 and I2 may be operated independently of each other.

The current I1 input through the first lead terminal and output to the common lead terminal through the first coil pattern may be a low current. The current I2 input through the second lead terminal and output to the common lead terminal through the second coil pattern may be a high current.

Although not illustrated in the drawing, the first coil pattern may have a structure in which a plurality of coil patterns are connected in series. A first coil pattern modified to have a structure with a plurality of coils connected in series would have a higher inductance than a single coil. As a result, inductor losses in a section (that is, a low current section) may be further decreased.

Figure 6:
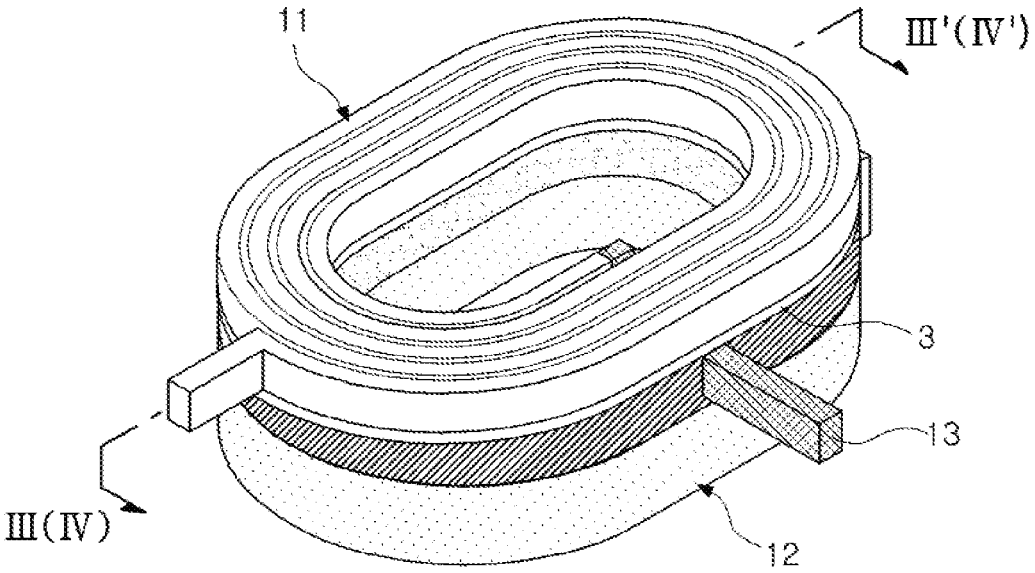
FIG. 6 is a schematic perspective view illustrating a modified example of the inductor of FIG. 1.
Figure 7:
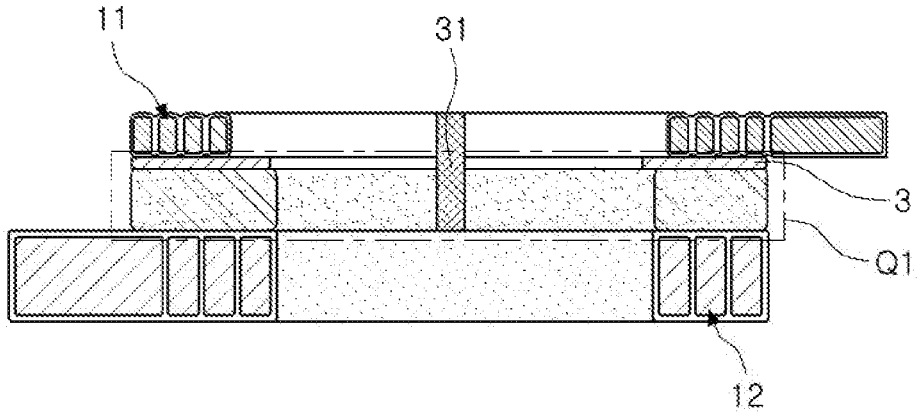
FIG. 7 is a cross-sectional view of an example of the inductor, taken along line III-III' of FIG. 6.

FIG. 6 is a schematic perspective view illustrating a modified example of the inductor of FIG. 1. FIG. 7 is a cross-sectional view of an example of the inductor taken along line III-III' of FIG. 6.

Referring to FIGS. 6 and 7, a support member 3 may be further disposed on at least one surface of one of the first coil pattern or the second coil pattern. FIGS. 6 and 7 illustrate an example where the support member 3 is disposed on a surface of the first coil pattern and between the first and second coil patterns, but the support member is not limited thereto. For example, the support member may be disposed below the second coil pattern 12.

The first coil pattern 11 and the second coil pattern 12 may be connected to each other through a first via 31 penetrating through the support member 3. The purpose of the support member 3 may be to form the first and second coil patterns at a thinner thickness and further facilitate formation of the first and second coil patterns. The support member 3 may be an insulating substrate formed of an insulating resin. The insulating resin may be a thermosetting resin such as an epoxy resin, a thermoplastic resin such as a polyimide resin, a resin having a reinforcement material such as a glass fiber or an inorganic filler impregnated in the thermosetting resin and the thermoplastic resin, such as prepreg, Ajinomoto Build up Film (ABF), FR-4, a Bismaleimide Triazine (BT) resin, a photo-imagable dielectric (PID) resin, or the like. Including glass fiber in the support member 3 may provide excellent rigidity. Alternatively, a polypropylene glycol (PPG) substrate, a ferrite substrate, a metal soft magnetic substrate, or the like, may be used for the support member 3.

The first coil pattern may be disposed on one surface of the support member. The first coil pattern may be a plating pattern formed by a general plating method, but is not limited thereto. The first coil pattern 11 may include a first seed layer 11*c* disposed on one surface of the support member and a first plating layer 11*d* formed on the first seed layer 11*c*. The first seed layer 11*c* may include a plurality of layers. For example, the first seed layer 11*c* may be disposed on a first adhesion layer containing one or more selected from the group consisting of titanium (Ti), titanium-tungsten (Ti—W), molybdenum (Mo), chromium (Cr), nickel (Ni), and nickel-chromium (Ni—Cr), and may include the same material as that of the first plating layer, such as copper (Cu). The first plating layer 11*d* may include a conductive material such as copper (Cu), aluminum (Al), silver (Ag), tin (Sn), gold (Au), nickel (Ni), lead (Pb), or alloys thereof.

Next, a common lead portion 13 connected to the first via 31, and led from the first via 31 to the common lead terminal, may be disposed on the other surface of the support member 3.

Since the common lead portion of the inductor according to the exemplary embodiment is led from the first via, a space in the inductor may be optimally utilized, thereby enabling miniaturization of the inductor.

Referring to FIG. 7, a magnetic material may be filled in a space Q1 that is coplanar with a plane on which the common lead portion 13 is disposed. The second coil pattern 12 having one end portion connected to the common lead portion 13 may be disposed below the common lead portion 13.

Figure 8:
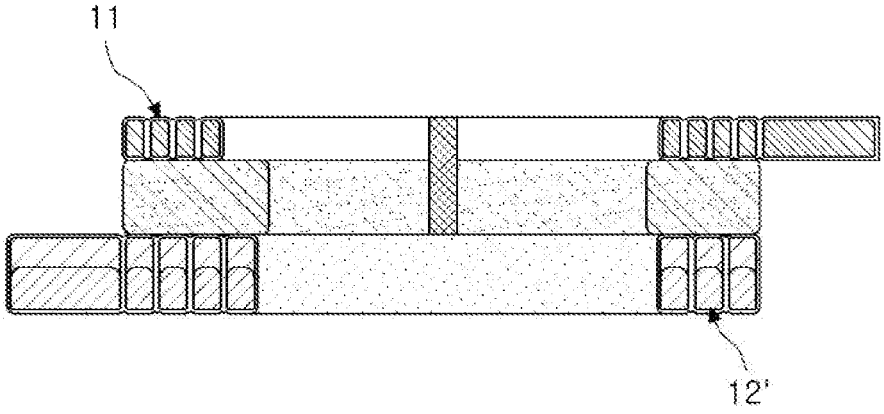
FIG. 8 is a cross-sectional view of another example of the inductor, taken along line IV-IV' of FIG. 6.

FIG. 8 is a cross-sectional view of an another example of the inductor taken along line IV-IV' of FIG. 6. For reference, line III-III' and line IV-IV' of FIG. 6 refer to cut lines in substantially the same direction but showing different examples.

Referring to FIG. 8, a second coil pattern 12' may be a coil pattern obtained by further growing a coil pattern grown in the thickness direction by making a growth speed of the coil pattern in the thickness direction higher than a growth speed of a coil pattern in the width direction at the time of growing the coil patterns.

In other words, the second coil pattern 12' may be a coil pattern formed in an anisotropic plating scheme.

The second coil pattern 12' of FIG. 8 may be thicker than that of a coil pattern formed in an isotropic plating scheme, where the growth speed of the coil pattern in the width direction is the same as the growth speed in the thickness direction, such that a DC resistance value per unit length may be decreased. As a result, inductor losses in a section (that is, a high current section) may be further decreased.

Figure 9:
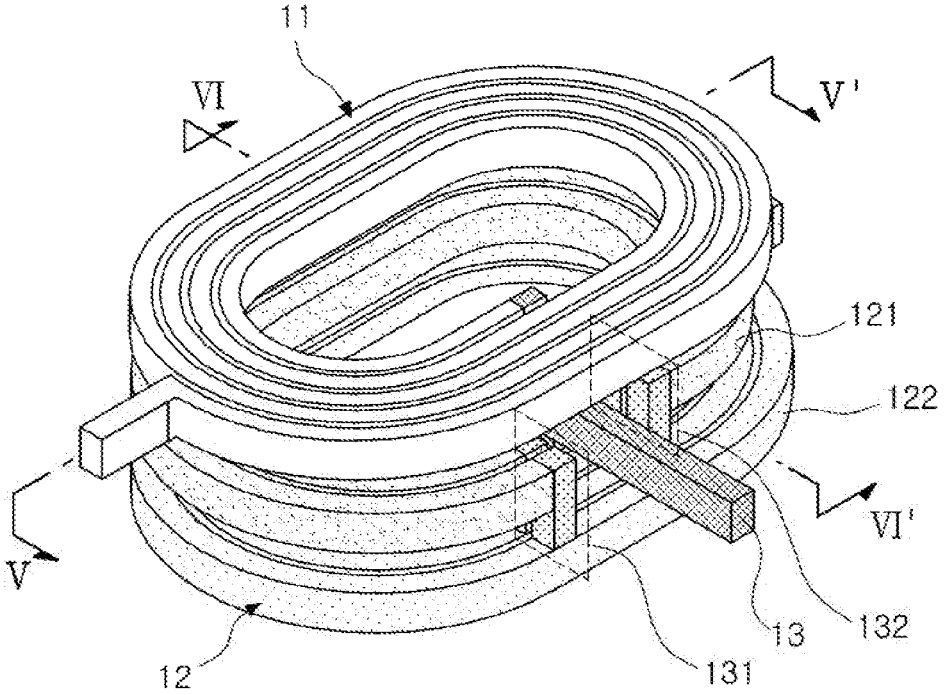
FIG. 9 is a schematic perspective view illustrating another modified example of the inductor of FIG. 1.
Figure 10:
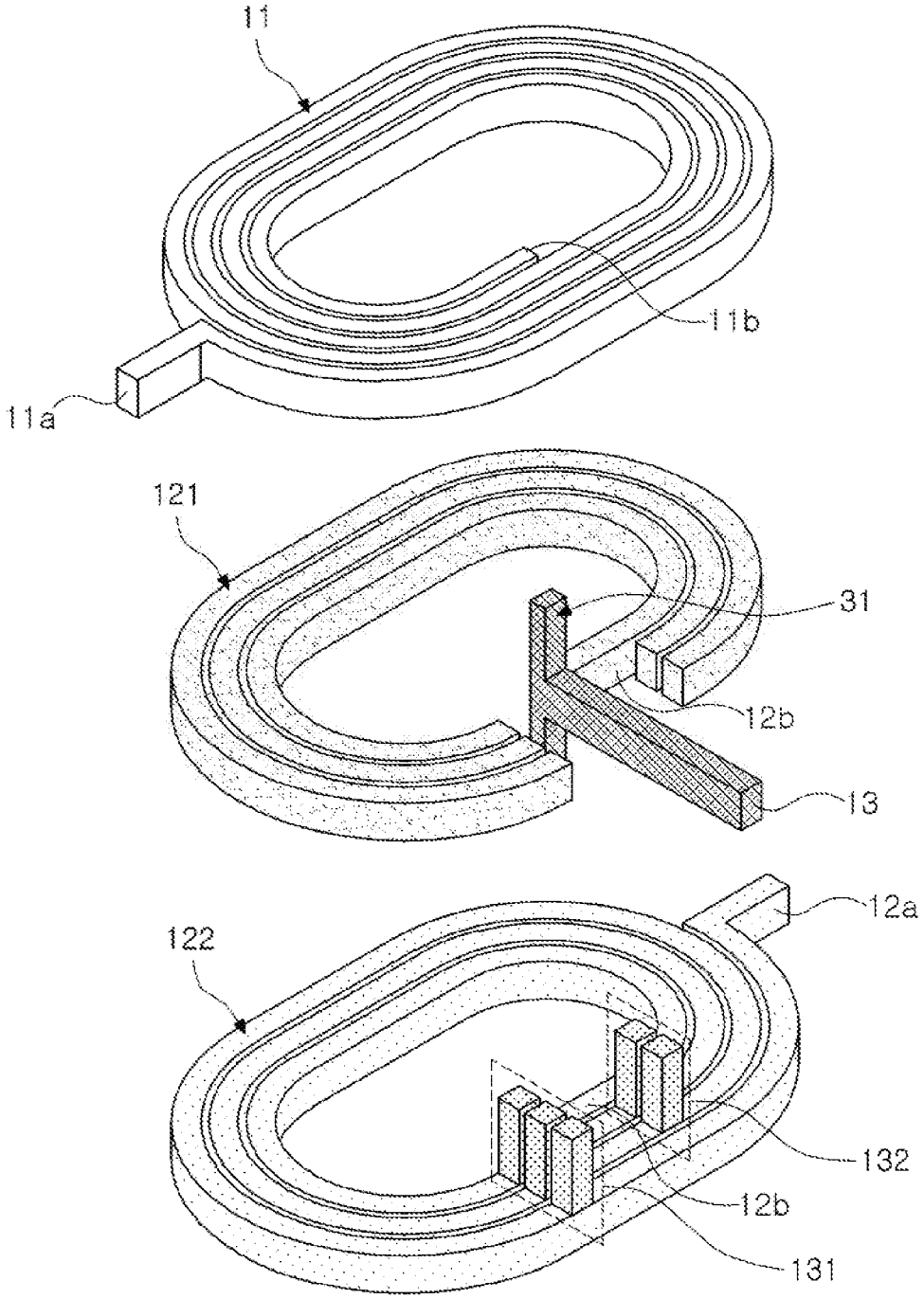
FIG. 10 is a schematic exploded perspective view of the inductor of FIG. 9.
Figure 11:
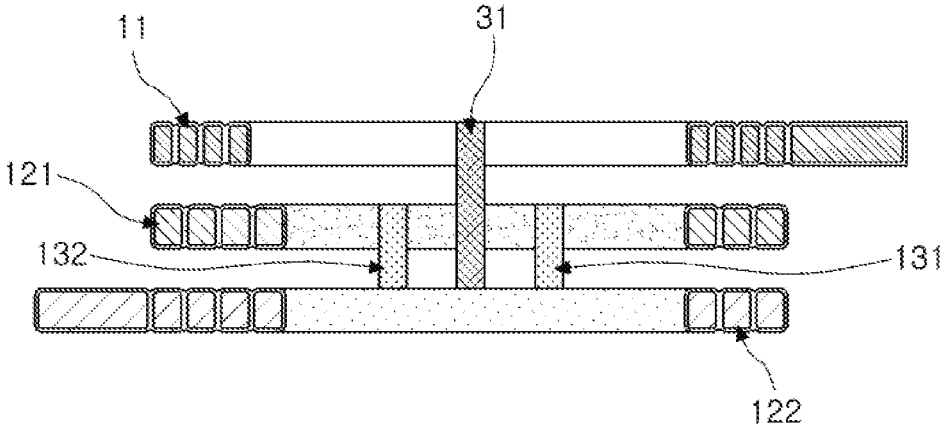
FIG. 11 is a cross-sectional view of the inductor taken along line V-V' of FIG. 9.
Figure 12:
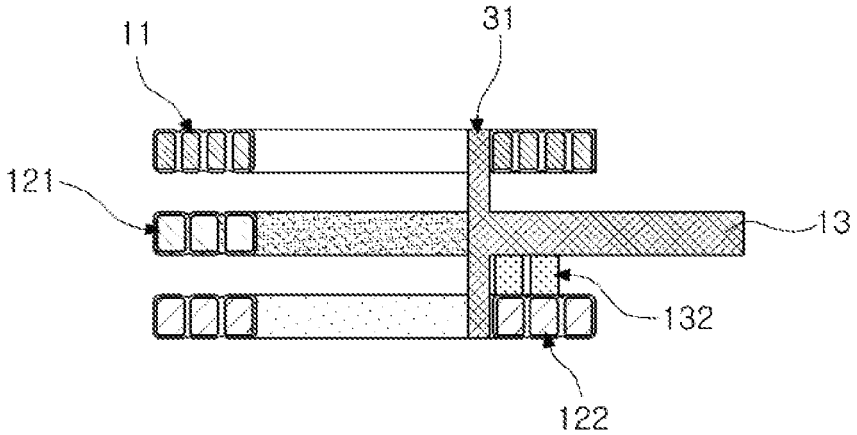
FIG. 12 is a cross-sectional view of the inductor taken along line VI-VI' of FIG. 9.

FIG. 9 is a schematic perspective view illustrating another modified example of the inductor of FIG. 1. FIG. 10 is a schematic exploded perspective view of the inductor of FIG. 9. FIGS. 11 and 12 are, respectively, schematic cross-sectional views of the inductor taken along line V-V' and line VI-VI' of FIG. 9.

The inductor of FIGS. 9 through 11 may include a second coil pattern 12. The second coil pattern 12 may include at least two coil patterns including a coil pattern 121 and a coil pattern 122. The coil pattern 121 and the coil pattern 122 may be disposed in parallel so that a current I2 may flow through the second coil pattern in parallel. Since the coil pattern 121 and the coil pattern 122 are connected in parallel, a DC resistance value per unit length of the second coil pattern 12 may be decreased as compared to a DC resistance value per unit length of one coil pattern that is the same as the coil pattern 121 or the coil pattern 122.

A lower surface of the coil pattern 121 may be disposed to oppose an upper surface of the coil pattern 122.

The coil pattern 121 may be disposed in the space corresponding to Q1 in FIG. 7, and may be coplanar with the plane on which the common lead portion 13 is disposed. Meanwhile, the coil pattern 122 may be disposed below the plane on which the common lead portion 13 is disposed. One end portion of the coil pattern 121 may be coplanar with the plane on which the common lead portion 13 is disposed, and one end portion of the coil pattern 122 may be coplanar with a plane on which the third end portion 12*a* is disposed.

Optionally, a support member (not illustrated) may be further disposed on at least one surface of one of the coil pattern 121 or the coil pattern 122.

For example, the support member may optionally be further disposed between the coil pattern 121 and the coil pattern 122 or the support member may optionally be further disposed on a lower surface of the coil pattern 122.

Where the support member is not disposed between the coil pattern 121 and the coil pattern 122, a magnetic material may be filled between the coil pattern 121 and the coil pattern 122.

In each of the first coil pattern 11, the coil pattern 121, and the coil pattern 122, thicknesses of a plurality of conductor patterns may be the same as one another. Therefore, a thickness of the first coil pattern may be thinner than that of the second coil pattern. In more detail, the first coil pattern may have a thickness corresponding to half of a thickness of the second coil pattern. In this embodiment, the thickness of the first coil pattern is half of the thickness of the second coil pattern because the first coil pattern consists of one coil pattern, whereas the second coil pattern consists of two coil patterns each having the same thickness as the one coil pattern of the first coil pattern.

The first coil pattern and second coil pattern may obtain the inductance and DC resistance value relationships described above by the first coil pattern having a smaller cross-sectional area than the second coil pattern. Different cross-sectional areas can be achieved, for example, by the second coil patterns having coil patterns with larger thicknesses and/or coil widths. Different cross-sectional areas can also be achieved with the second coil pattern having coil patterns with the same thicknesses as the coil pattern or patterns of the first coil pattern, with the second coil pattern including more coil patterns than the first coil pattern.

The coil pattern 121 and the coil pattern 122 may be connected to each other through second vias 131 and third vias 132. The second and third vias 131 and 132 may have a structure in which a conductive material is filled in a plurality of via holes, respectively.

The number of via holes included in each of the second and third vias may be appropriately selected in consideration of an applied current value, or the like, and is not particularly limited. For example, the number of via holes included in each of the second and third vias may be the same as, greater than, or smaller than the turn of conductor patterns constituting the coil pattern 121.

For example, the number of via holes included in the second via 131 may be the same as the turn of conductor patterns constituting the coil pattern 121 and the number of via holes included in the third via 132 may be smaller than the turn of conductor patterns constituting the coil pattern 121. However, the number of via holes included in each of the second and third vias is not limited thereto.

The second and third vias 131 and 132 may be disposed on the upper surface of the coil pattern 122 to be spaced apart from each other.

A low current I1 input from the first lead terminal may flow between the first end portion 11*a* and the second end portion 11*b* of the first coil pattern, while a high current I2 input from the second lead terminal may be input through the third end portion 12*a* of the coil pattern 122 and be output through the fourth end portion 12*b* of the coil pattern 121. In this case, the high current I2 may pass through both of the second and third vias disposed between the coil pattern 121 and the coil pattern 122, thereby forming a current flow in parallel.

Figure 13:
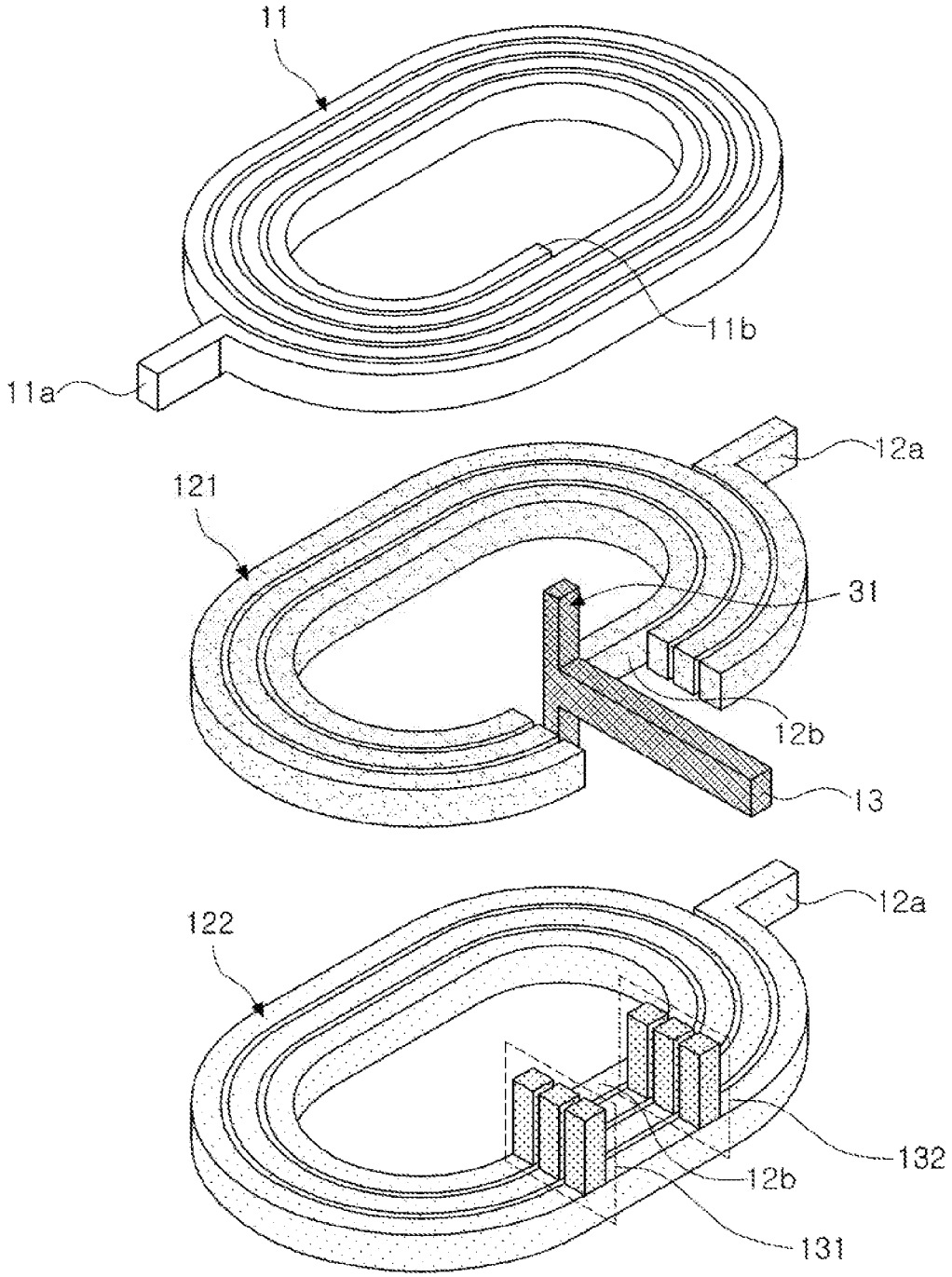
FIG. 13 is a schematic exploded perspective view of a modified example of the inductor of FIG. 9.

FIG. 13 is a schematic exploded perspective view of a modified example of the inductor of FIG. 9. The inductor of FIG. 13 is different in the number of via holes included in a third via 132 from the inductor of FIG. 10. One via hole may be further added to the third via 132. Therefore, a conductor pattern of a second coil pattern connected to the via hole in the third via 132 may also be added. FIG. 13 is also different in the coil pattern 121 having a third end portion 12*a*.

As set forth above, according to the exemplary embodiment in the present disclosure, power inductor losses may be significantly decreased to significantly increase efficiency.

While exemplary embodiments have been shown and described above, it will be apparent to those skilled in the art that modifications and variations could be made without departing from the scope of the present invention as defined by the appended claims.

What is claimed is:

1. An inductor comprising:

a first coil pattern including a first end portion and a second end portion electrically connected to the first end portion;

a second coil pattern including a third end portion and a fourth end portion electrically connected to the third end portion;

a first lead terminal electrically connected to the first end portion of the first coil pattern;

a second lead terminal electrically connected to the third end portion of the second coil pattern; and a common lead terminal electrically connected to both the second end portion of the first coil pattern and the fourth end portion of the second coil pattern, the common lead terminal being arranged outside of at least one of the first coil pattern or the second coil pattern, wherein an inductance value of the first coil pattern is greater than that of the second coil pattern, a direct current (DC) resistance value per unit length of the first coil pattern is greater than that of the second coil pattern, and the first coil pattern and the second coil pattern are connected to each other in parallel.

2. The inductor of claim 1, wherein:

the common lead terminal is a lead terminal for an output, and the first lead terminal and the second lead terminal are each lead terminals for an input, and the common lead terminal outputs a current input through the first lead terminal or a current input through the second lead terminal.

3. The inductor of claim 1, wherein an Irms value of the first coil pattern is smaller than that of the second coil pattern.

4. The inductor of claim 3, wherein the Irms value of the first coil pattern is equal to or smaller than a current value at which an alternating current (AC) loss value of the inductor is the same as a DC loss value of the inductor.

5. The inductor of claim 1, further comprising:

a body including a magnetic material and embedding the first and second coil patterns; and a first via electrically connecting the second end portion of the first coil pattern to the fourth end portion of the second coil pattern.

6. The inductor of claim 5, further comprising a common lead portion electrically connecting the first via to the common lead terminal.

7. The inductor of claim 1, further comprising a support member disposed on at least one surface of one of the first coil pattern or the second coil pattern.

8. The inductor of claim 1, wherein:

widths of a plurality of conductor patterns of the first coil pattern are smaller than those of a plurality of conductor patterns of the second coil pattern, and a thickness of the first coil pattern is smaller than that of the second coil pattern.

9. The inductor of claim 1, wherein the second coil pattern includes at least two coil patterns electrically connected to each other in parallel.

10. The inductor of claim 9, wherein turns of conductor patterns of two or more of the at least two coil patterns are the same as each other.

11. The inductor of claim 9, wherein a thickness of the first coil pattern is the same as that of each of the at least two coil patterns.

12. The inductor of claim 9, wherein:

two of the at least two or more coil patterns are connected to each other by a second via and a third via, and the second via and the third via each have a structure where a conductive material is filled in a plurality of via holes.

13. The inductor of claim 12, wherein:

the second and third vias are disposed on an upper surface of one of the two coil patterns to be spaced apart from each other, and the respective via holes for the second and third vias are connected to respective upper surfaces of a plurality of conductor patterns constituting the one of the two coil patterns.

14. The inductor of claim 12, wherein:

the number of via holes for the second via is the same as a turn of conductor patterns constituting the other of the two coil patterns, and the number of via holes for the third via is equal to or less than a turn of conductor patterns constituting the other of the two coil patterns.

15. The inductor of claim 9, further comprising a common lead portion electrically connecting the first via to the common lead terminal, wherein:

one end portion of one of the at least two coil patterns is coplanar with a plane on which the common lead portion is disposed, and one end portion of another of the at least two coil patterns is coplanar with a plane on which the third end portion is disposed.

16. The inductor of claim 9, further comprising a support member disposed between two of the at least coil patterns.

17. An inductor comprising:

a first coil pattern electrically connected between a first lead terminal and a common lead terminal; and a second coil pattern electrically connected between a second lead terminal and the common lead terminal, the common lead terminal being arranged outside of at least one of the first coil pattern or the second coil pattern, wherein an inductance value of the first coil pattern is greater than that of the second coil pattern, and a DC resistance value per unit length of the first coil pattern is greater than that of the second coil pattern, and the first coil pattern and the second coil pattern are connected to each other in parallel.

18. The inductor of claim 17, further comprising:

a via electrically connecting the first coil pattern and the second coil pattern; and a common lead portion electrically connecting the via to the common lead terminal.

19. The inductor of claim 17, wherein the second coil pattern comprises a plurality of coil patterns electrically connected in parallel by a plurality of vias.

20. The inductor of claim 17, wherein a cross-sectional area of a coil of the second coil pattern is greater than a cross-sectional area of a coil of the first coil pattern.

21. An inductor, comprising:

a first coil pattern electrically connected between a first lead terminal and a common lead terminal; and a second coil pattern electrically connected between a second lead terminal and the common lead terminal, the common lead terminal being arranged outside of at least one of the first coil pattern or the second coil pattern, wherein a cross-sectional area of the second coil pattern is greater than that of the first coil pattern, and the first coil pattern and the second coil pattern are connected to each other in parallel.

22. The inductor of claim 21, wherein:

widths of a plurality of coils of the first coil pattern are smaller than those of a plurality of coils of the second coil pattern, and a thickness of the first coil pattern is smaller than that of the second coil pattern.

23. The inductor of claim 22, wherein:

the second coil pattern includes a plurality of coil patterns that each include coils with a thickness the same as that of coils of the first coil pattern, and the thickness of the second coil pattern is the thickness of the plurality of coil patterns multiplied by an amount of the plurality of coil patterns.

24. The inductor of claim 22, wherein:

a thickness of coils in the second coil pattern is greater than a thickness of coils in the first coil pattern.

* * * * *